US006637792B1

(12) United States Patent
McCoy et al.

(10) Patent No.: US 6,637,792 B1
(45) Date of Patent: Oct. 28, 2003

(54) MUD PAN SUPPORT DEVICE

(75) Inventors: Charles D. McCoy, Sarasota, FL (US); Mark McCourt, Bradenton, FL (US); Roy Yahraus, Sarasota, FL (US)

(73) Assignee: Pro-Line, Inc., Sarasota, FL (US)

( * ) Notice: Subject to any disclaimer, the term of this patent is extended or adjusted under 35 U.S.C. 154(b) by 0 days.

(21) Appl. No.: 10/178,031

(22) Filed: Jun. 21, 2002

(51) Int. Cl.[7] ..... F04G 21/16; A47G 1/17

(52) U.S. Cl. ..... 294/3.5; 248/206.5; 248/683; 220/755

(58) Field of Search ..... 248/206.5, 683; 220/755, 770; 294/3.5

(56) References Cited

U.S. PATENT DOCUMENTS

| | | | | | |
|---|---|---|---|---|---|
| 1,348,516 | A | * | 8/1920 | Peck | 294/3.5 |
| 1,861,174 | A | * | 5/1932 | Applegate | 294/3.5 |
| 2,661,858 | A | * | 12/1953 | Howell | 15/257.06 |
| 2,679,998 | A | * | 6/1954 | Keller | 248/205.3 |
| 3,112,225 | A | * | 11/1963 | Harms | 118/43 |
| 3,504,878 | A | * | 4/1970 | Dressler | 248/205.3 |
| 3,790,201 | A | * | 2/1974 | Morsilli | 294/3.5 |
| 3,827,020 | A | * | 7/1974 | Okamoto | 335/285 |
| 4,436,214 | A | * | 3/1984 | Henderson | 220/628 |
| 4,609,173 | A | * | 9/1986 | Belokin | 248/223.41 |
| 4,753,471 | A | * | 6/1988 | Gringer | 294/3.5 |
| 4,802,702 | A | | 2/1989 | Bownds | |
| 4,901,960 | A | * | 2/1990 | Gary | 248/205.3 |
| 5,067,761 | A | * | 11/1991 | Blowers | 294/3.5 |
| 5,098,052 | A | * | 3/1992 | Beck | 248/238 |
| 5,186,507 | A | * | 2/1993 | Neidfeld | 294/3.5 |
| 5,193,793 | A | * | 3/1993 | Pollock | 269/302.1 |
| 5,221,006 | A | * | 6/1993 | Plumlee et al. | 206/350 |
| 5,261,584 | A | * | 11/1993 | Albert | 224/270 |
| 5,603,428 | A | | 2/1997 | Breckwoldt | |
| 5,803,422 | A | * | 9/1998 | Buehler | 248/339 |
| 6,006,936 | A | | 12/1999 | Przbylowicz | |
| 6,042,080 | A | * | 3/2000 | Shepherd et al. | 248/683 |
| 6,179,377 | B1 | * | 1/2001 | Harper | 297/148 |
| 6,405,983 | B1 | * | 6/2002 | Goj | 248/205.1 |
| 6,454,124 | B1 | * | 9/2002 | Edwards et al. | 220/636 |
| 6,520,661 | B1 | * | 2/2003 | Hill | 362/252 |

* cited by examiner

*Primary Examiner*—Leslie A. Braun
*Assistant Examiner*—Amy J. Sterling
(74) *Attorney, Agent, or Firm*—Charles J. Prescott

(57) ABSTRACT

A mud pan support device magnetically attachable to, and releasable from, a flat bottom panel of a mud pan to be carried in one hand while applying joint compound with a trowel or mud spreading tool held in the other hand. The device includes an elongated substantially flat support panel and a handle connected to and extending from a central area of one surface of the support panel. A substantially flat magnetized panel is connected to, and is at least partially coextensive with, another surface of the support panel and is sized to be at least partially coextensive with the bottom panel of the mud pan. The magnetized panel is of sufficient magnetically attractive strength to serve as an only means for secure magnetic engagement between the magnetized panel and the bottom panel when the mud pan is filled with mud or plaster.

6 Claims, 2 Drawing Sheets

A
B
22
20
18
10

12
20
16
22

A
14
12
10
16
22
18
20
B

MUD PAN SUPPORT DEVICE

BACKGROUND OF THE INVENTION

1. Scope of Invention

This invention relates generally to containers for holding uncured plaster and joint compounds for use in wallboard finishing by drywall finishers and plasterers, and more particularly to a support device for a mud pan used by such drywall finishers and plasterers for holding a quantity of mud of wet plaster.

2. Prior Art

In finishing drywall construction, a trough is held by a worker which holds a supply of uncured plaster or joint-compound "mud" while applying the uncured material with a trowel or spreading device onto the walls and ceilings to cover joint tape and other blemishes before final finish and painting of the walls and ceilings. The most economical and widely accepted mode of holding and carrying a quantity of uncured mud or plaster is in the form of a "mud pan" which is an elongated thin metal fabricated trough having a flat bottom and flat outwardly tapering sides defining an open upper end thereof. A worker will simply grasp the outer surfaces of the mud pan which is filled with the mud or joint compound and then manipulate the mud pan with one hand while dipping the mud therefrom with the spreading implement such as a trowel and the like onto the wall surfaces.

Holding the metal-formed mud pan itself, even partially filled with mud or plaster, is difficult at best and can only be done by a worker who has been seasoned on the job. The hand and finger gripping strength and endurance for manually holding the mud pan is therefore substantial.

A number of prior art devices and apparatus are known to applicant which in some way address the issue of the shape and retention of a mud pan or other articles for holding paint mixtures and the like which, in some way, assist the worker by reducing or facilitating the holding of the mud pan or tray when filled with a quantity of appropriate spreadable material.

U.S. Pat. No. 3,790,201 Morsilli

U.S. Pat. No. 4,802,702 Bownds

U.S. Pat. No. 5,067,761 Blowers

U.S. Pat. No. 5,603,428 Breckwoldt

U.S. Pat. No. 6,006,936 Przybylowicz

All of the above inventions, however, deal with an improved mud pan or tray structure itself which, if adopted, would necessarily require the abandonment of the well recognized and industry standard mud pan. The present invention provides a magnetically attachable support device for existing mud pans which greatly facilitates the manual holding and manipulating of a mud pan when filled with even large quantities of uncured mud, joint compound or plaster material.

BRIEF SUMMARY OF THE INVENTION

This invention is directed to a mud pan support device magnetically attachable to, and releasable from, a flat bottom panel of a mud pan to be carried in one hand while applying joint compound with a trowel or mud spreading tool held in the other hand. The device includes an elongated substantially flat support panel and a handle connected to and extending from a central area of one surface of the support panel. A substantially flat magnetized panel is connected to, and is at least partially coextensive with, another surface of the support panel and is sized to be at least partially coextensive with the bottom panel of the mud pan. The magnetized panel is of sufficient magnetically attractive strength to be an only means required for secure magnetic engagement between the magnetized panel and the bottom panel when the mud pan is filled with mud or plaster.

It is therefore an object of this invention to provide an easily attachable support device for conventional existing mud pans which greatly facilitates the use and retention of the mud pan when filled with uncured mud or plaster.

Still another object of this invention is to provide a support device which is magnetically attachable to a conventional mud pan which reduces the fatigue factor in the manual holding of the mud pan when filled with plaster or mud material Yet another object of this invention is to provide a support device which is magnetically attachable to, and easily removable from, the bottom surface of a conventional mud pan and is of sufficient magnetically attractive strength so as to facilitate the easier holding and manipulation of a mud pan when filled with uncured plaster or mud material without excessive hand fatigue of a worker.

In accordance with these and other objects which will become apparent hereinafter, the instant invention will now be described with reference to the accompanying drawings.

DETAILED DESCRIPTION OF THE INVENTION

Figure 1:
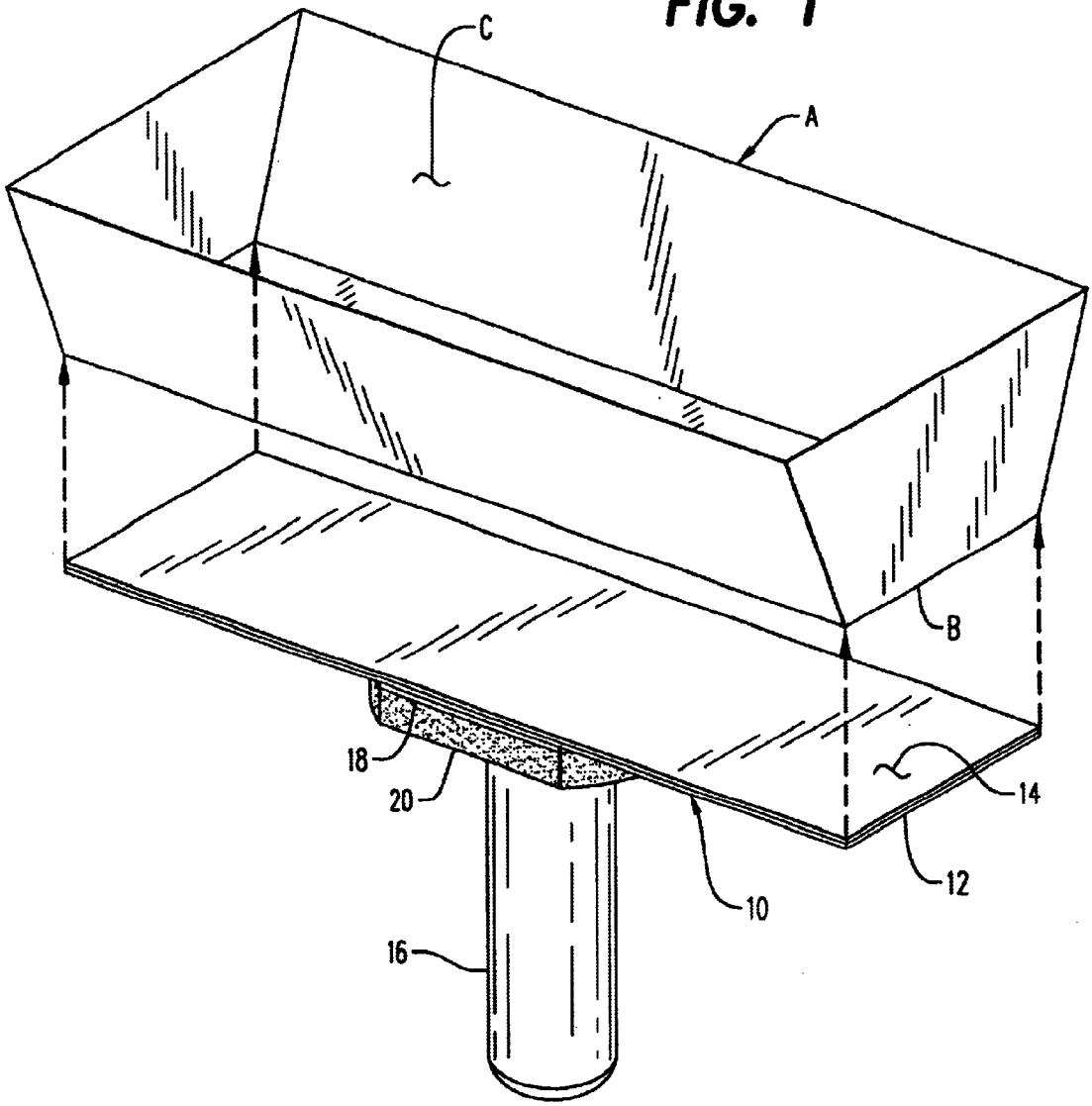
FIG. 1 is a perspective view of the invention in exploded relationship to the bottom surface of a conventional magnetic metal mud pan.
Figures 2, 3, 4:
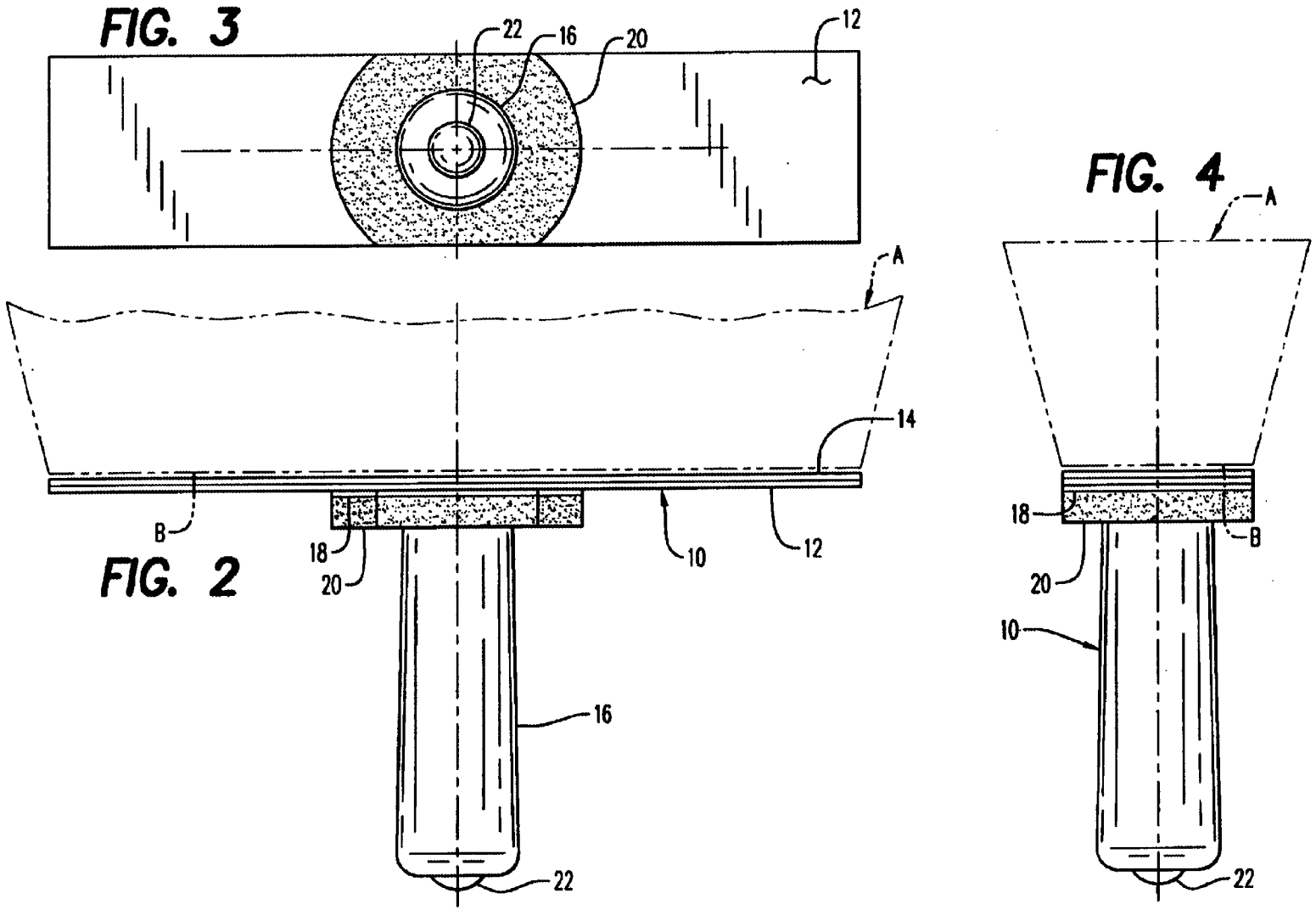
FIG. 2 is a side elevation view of the preferred embodiment of the invention as shown in FIG. 1 showing a portion of the mud pan attached thereto in phantom.
FIG. 3 is a bottom plan view of the invention as shown in FIG. 2.
FIG. 4 is an end elevation view of the invention as shown in FIG. 2 with the mud pan outlined in phantom.

Referring now to the drawings, the invention is there shown in its preferred embodiment at numeral 10. The device 10 is magnetically attachable to a conventional metal fabricated mud pan shown generally at numeral A which includes a flat metallic bottom B and defining an interior upwardly open cavity C for receiving a quantity of uncured mud or plaster therein to be carried in one hand and spread by a tool held in the other hand of a worker. The mud or plaster material is typically spread onto drywall installations for covering over taped joints and other blemishes in the drywall installation of walls and ceilings before final sanding and painting or wall covering occurs.

The device 10 includes an elongated flat support panel 14 which is preferably rigid and may also be of a magnetically attractive material such as steel. The thickness of this support panel 12 is in the range of approximately 0.08". A generally coextensive layer or panel of highly magnetized material 14 is attached to the upper surface of the support panel 12 with the use of adhesive or other attaching means in addition to the normally magnetically attractive forces therebetween. The magnetized panel 14 is preferably selected from the state of the art ceramic particle magnetized sheet which have a superior magnetic attraction. The preferred embodiment of these magnetized panels 14 has a thickness of approximately 0.04" to 0.12" and is characterized as being smooth and flexible and as having single or multiple poles and may also be of a conventional magnetic strength due to the large surface area involved.

An elongated, preferably upwardly tapering handle 16 is also provided and is rigidly connected by an elongated bolt 22 to a central area of the bottom or reverse surface of the support panel 12. For added strength, an additional rigid metallic panel 18 is also provided so as to reduce the flexing tendency of the support panel 12 and to increase the strength of the mechanical attachment of the handle 16.

A compressible foam pad 20 is also provided which snugly or forcibly fits over the distal end of the handle 16 and is slidable upwardly so as to be positioned against the obverse surface of the support panel 12 and the reinforcing panel 18. The compressible pad 20 provides a margin of comfort as the compressible pad 20 conforms to the hand of the worker thereagainst as he grasps the handle 16 and bears the weight of the mud pan A.

In use, a worker would ensure that the bottom surface B is clean and free of debris or hardened mud or plaster material, insure likewise for the exposed surface of the magnet panel 14 and then simply place the two surfaces together as shown by the arrows in FIG. 1.

It is important to insure that the strength of the magnetic/adhesive attachment between the support panel 12 and the magnetized panel 14 is sufficiently greater than the magnetic attraction forces only between the magnetized panel 14 and the bottom B of the mud pan A. This is to insure that, when the device 10 is separated from the bottom B, that the magnetized panel 14 remains attached to the support panel 12.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In combination, a mud pan and a mud pan support device magnetically attachable to, and releasable from, a flat bottom panel of said mud pan to be carried in one hand while applying joint compound with a trowel or mud spreading tool held in the other hand, comprising:

said mud pan;

an elongated substantially flat support panel;

a handle connected to and extending from a central area of a bottom surface of said support panel;

a substantially flat magnetized panel attached to, and at least partially coextensive with, a top surface of said support panel and sized to be at least partially coextensive with the bottom panel;

said magnetized panel being of sufficient magnetically attractive strength to maintain secure magnetic engagement between said magnetized panel and the bottom panel of said mud pan when the mud pan is filled with mud or plaster;

said support device for reducing the fatigue factor in the manual holding of the mud pan during use.

2. A mud pan support device as set forth in claim 1, further comprising:

a substantially flat compressible pad having a central aperture formed therethrough sized to snugly or forcibly fit over said handle and thereby be positionable against said support panel;

said pad pressing against and providing a comfortable weight-bearing surface for the one hand.

3. In a mud pan carried in one hand while applying joint compound drawn from the mud pan with a trowel or mud spreading tool held in the other hand, the mud pan having a flat magnetic uninterrupted bottom panel and upwardly opening side panels, the improvement comprising a mud pan support device including:

an elongated substantially flat support panel;

a handle connected to and extending from a central area of a bottom surface of said support panel;

a substantially flat magnetized panel attached to, and substantially coextensive with, a top surface of said support panel, said magnetized panel sized to be substantially coextensive with the bottom panel for maximizing the common surface area between said magnetized panel and the bottom panel of the mud pan;

said magnetized panel being of sufficient magnetically attractive strength to provide an only means for attachment between said magnetized panel and the bottom panel when the mud pan is filled with mud or plaster;

said support device for reducing the fatigue factor in the manual holding of the mud pan during use.

4. A mud pan support device as set forth in claim 3, further comprising:

a substantially flat compressible pad having a central aperture formed therethrough sized to snugly or forcibly fit over said handle and thereby be positionable against said support panel;

said pad pressing against and providing a comfortable weight-bearing surface for the one hand.

5. A mud pan support device magnetically attachable to, and releasable from, a magnetic flat bottom panel of a an upwardly opening mud pan said support device with the mud pan magnetically attached thereatop to be carried in one hand while applying joint compound with a trowel or mud spreading tool held in the other hand, comprising:

an elongated substantially flat support panel;

a handle connected to and extending orthogonally from a central area of a reverse surface of said support panel;

a substantially flat magnetized panel connected to, and substantially coextensive with, an obverse surface of said support panel, said magnetized panel also substantially coextensive with the bottom panel of the mud pan;

said magnetized panel being of sufficient magnetically attractive strength and surface area to provide an only means for releasable engagement between said magnetized panel and the bottom panel when the mud pan is filled with mud or plaster;

said support device for reducing the fatigue factor in the manual holding of the mud pad during use.

6. A mud pan support device as set forth in claim 5, further comprising:

a substantially flat compressible pad having a central aperture formed therethrough sized to snugly or forcibly fit over said handle and thereby be positionable against said support panel;

said pad pressing against and providing a comfortable weight-bearing surface for the one hand.

* * * * *